US011536056B2

(12) United States Patent
Fuchs

(10) Patent No.: US 11,536,056 B2
(45) Date of Patent: Dec. 27, 2022

(54) LOCKING DEVICE FOR A MOTOR VEHICLE

(71) Applicant: Kiekert AG, Heiligenhaus (DE)

(72) Inventor: Carsten Fuchs, Essen (DE)

(73) Assignee: Kiekert AG, Heiligenhaus (DE)

( * ) Notice: Subject to any disclaimer, the term of this patent is extended or adjusted under 35 U.S.C. 154(b) by 1044 days.

(21) Appl. No.: 16/311,004

(22) PCT Filed: Jun. 20, 2017

(86) PCT No.: PCT/DE2017/100513
§ 371 (c)(1),
(2) Date: Dec. 18, 2018

(87) PCT Pub. No.: WO2018/006899
PCT Pub. Date: Jan. 11, 2018

(65) Prior Publication Data

US 2019/0178011 A1 Jun. 13, 2019

(30) Foreign Application Priority Data

Jul. 4, 2016 (DE) ..... 10 2016 112 182.7

(51) Int. Cl.
*E05B 77/06* (2014.01)
*E05B 79/20* (2014.01)
*E05B 81/16* (2014.01)

(52) U.S. Cl.
CPC ..... *E05B 77/06* (2013.01); *E05B 79/20* (2013.01); *E05B 81/16* (2013.01)

(58) Field of Classification Search
CPC ..... E05B 77/02; E05B 77/04; E05B 77/06; E05B 79/20; E05B 81/16; E05B 85/20; E05B 85/24; E05B 85/243; E05B 85/26; Y10T 292/1047; Y10T 292/1078; Y10S 292/22; Y10S 292/23; Y10S 292/65
See application file for complete search history.

(56) References Cited

U.S. PATENT DOCUMENTS 5,803,515 A * 9/1998 Arabia, Jr. ..... E05B 85/243 292/201
5,975,596 A * 11/1999 Rogers, Jr. ..... E05B 85/243 292/216

(Continued)

FOREIGN PATENT DOCUMENTS

DE 202012007312 11/2013
DE 202013104118 12/2014

(Continued)

OTHER PUBLICATIONS

Computer Generated Translation for DE 102014004550 A1, Generated on Jan. 6, 2022, https://worldwide.espacenet.com/ (Year: 2022).*

(Continued)

*Primary Examiner* — Alyson M Merlino
(74) *Attorney, Agent, or Firm* — Renner, Otto, Boisselle & Sklar, LLP

(57) ABSTRACT

A locking device for a motor vehicle comprising an actuator, a lock with a locking mechanism, comprising a rotary latch and at least one pawl, the actuator and the lock can be interconnected by a Bowden cable and the Bowden cable has provision for actively blocking a force transmitted by the Bowden cable.

19 Claims, 4 Drawing Sheets

(56) References Cited

U.S. PATENT DOCUMENTS

| | | | | |
|---|---|---|---|---|
| 6,932,393 | B2 * | 8/2005 | Erices | E05B 81/16 292/216 |
| 10,337,214 | B2 * | 7/2019 | Topfer | E05B 77/06 |
| 11,072,947 | B2 * | 7/2021 | Reddmann | E05B 77/06 |
| 2015/0167364 | A1 * | 6/2015 | Gweon | E05B 77/06 292/200 |
| 2015/0240536 | A1 * | 8/2015 | Cumbo | E05B 77/06 292/200 |
| 2015/0240537 | A1 * | 8/2015 | Cumbo | E05B 77/06 292/200 |
| 2016/0060908 | A1 * | 3/2016 | Kim | E05B 79/20 292/336.3 |
| 2016/0160540 | A1 * | 6/2016 | Bejune | E05B 77/06 292/196 |

FOREIGN PATENT DOCUMENTS

| | | | | |
|---|---|---|---|---|
| DE | 102014001490 | | 7/2015 | |
| DE | 102014002581 | | 8/2015 | |
| DE | 102014004550 | | 10/2015 | |
| DE | 102015001906 | | 8/2016 | |
| GB | 2200943 | A * | 8/1988 | E05B 79/20 |
| WO | 02/20925 | | 3/2002 | |
| WO | 2015/149743 | | 10/2015 | |

OTHER PUBLICATIONS

International Search Report and Written Opinion for corresponding Patent Application No. PCT/DE2017/100513 dated Sep. 12, 2017.
Search Report of DE Application No. 10 2016 112 182.7 dated Mar. 15, 2017.

* cited by examiner

LOCKING DEVICE FOR A MOTOR VEHICLE

FIELD OF INVENTION

The invention relates to a locking device for a motor vehicle with an actuating means, in particular an external actuating lever and/or an internal actuating lever, a lock with a locking mechanism, comprising a catch and at least one pawl, wherein the actuating lever and the lock are connectable to a Bowden cable.

BACKGROUND OF INVENTION

A lock for a motor vehicle, also known as a locking system, is largely installed onto the locking mechanisms which consist of a catch and at least one pawl. The locking mechanism in the lock interacts with a lock holder which is either attached to the chassis of the motor vehicle or the door, flap, sliding door, etc. The relative movement between the lock holder and the catch causes the catch to be pivoted and simultaneously the pawl engages with the catch.

SUMMARY OF INVENTION

According to the embodiment, there is a one- or two-step locking mechanism which then has a pre-latching and or a main latching position. The pawl is preferably engaged with the catch in a spring pre-tensioned manner. A release lever is used for unlocking, i.e. to detach the pawl from the catch. Here, the pawl is acted on by the release lever in such a way that the pawl disengages from the catch and the catch moves from the latching position into an opening position. The movement of the catch is in this case usually by means of a spring element and/or due to a tensile stress resulting from the lock holder in combination with the door seal.

An actuating lever is used to operate the release lever. The actuating lever may be, for example, an inside actuating lever or an outside actuating lever. With the help of the actuating lever, the release lever is moved and unlocks the locking mechanism.

Bowden cables are often used between an external actuating lever and the lock or an internal actuating lever and the lock. Bowden cables have the advantage that they can be used flexibly and that high forces can be transmitted safely and with low losses.

To increase the safety in motor vehicles, systems are used, that are equipped with mass inertia elements. In this case, the mass inertia elements counteract an external momentum and thereby prevent, for example, a side door of a motor vehicle from being inadvertently being opened. A momentum can be initiated by a collision into the vehicle, for example. If, for example, a momentum is initiated into the motor vehicle during a lateral impact such that, for example, a door handle of a lateral door is accelerated, the deflection of the door handle can thus cause the actuating lever to be activated and the locking mechanism to be opened, whereby unintentional opening of the lateral door can occur. In order to prevent such unwanted events, mass inertia-based locking systems have become known which counteract unintentional opening of a door lock.

A motor vehicle door lock is known from DE 20 2013 104 118 U1 which is equipped with a mass inertia lock. The motor vehicle lock comprises a bolting arrangement equipped with a control lever and a coupling element. The coupling element is configured with a spring arrangement. In the case of a not operated actuating lever, the bolting arrangement is bolted or is only unbolted in a spring-driven manner during operation of the actuating lever. If, during operation of the actuating lever, an actuating speed which is above a predetermined limit speed is reached, the mass inertia of the control lever ensures that the actuation of the actuating lever takes place with a delay.

Furthermore, a motor vehicle lock with an actuating lever and a coupling arrangement is known from DE 20 2012 007 312 U1. The actuating lever interacts with the coupling arrangement such that the relevant actuating lever uncouples the coupled coupling arrangement and leaves the uncoupled coupling arrangement in the uncoupled state. If, in the event of an accident, operation of the actuating lever occurs at an actuating speed above a certain limit speed, then the actuating lever executes an idle stroke because of the inertia-delayed deceleration of the coupling arrangement.

A mass inertia-based operating system for a release lever has become known from DE 10 2014 001 490 A1. The actuating lever interacts with a coupling lever which is pivotably mounted on the release lever. A spring sitting on the actuating lever engages on the coupling lever and thus enables the coupling lever to couple during operation of the actuating lever. When engaged, the locking mechanism can be unlocked using the release lever. In addition, a bolting lever is provided for by means of which the coupling lever can be uncoupled, as also in the case of an accident caused by inertia.

A further mass inertia-based flow system in a lock for a motor vehicle with a separate mass inertia element has become known from DE 10 2014 002 581 A1. A coupling lever is mounted on an actuating lever and lies in a position in a spring-tensioned manner in which the coupling lever engages with the release lever during operation of the actuating lever.

In the case of exceeding a limit speed of the operation of the actuating lever, a locking lever acts on the coupling joint so that the coupling joint disengages with the release lever. The locking lever in turn lies adjacent in a spring pre-tensioned manner on the release lever and can follow the movement of the actuating lever if the actuating lever is operated with a normal operating speed. In the case of an accident, and thus excessive speed of the actuating lever, the control lever cannot follow the movement of the actuating lever by means of the mass inertia element engaged with the control lever and engages with the coupling lever. The control lever causes the coupling lever to be deflected. Bolting of the release mechanism for the lock can hereby occur by, for example, the mass inertia element being fixed in the deflected state in which the control lever is engaged with the coupling lever so that also during further operation of the actuating lever no unlocking of the locking mechanism can occur.

The securing systems known from the state of the art are usually based on the coupling joint being controlled by means of a spring element. Spring elements can have great fluctuations in spring constants caused by material characteristics and manufacturing processes. A defined configuration of the springs therefore requires greater effort. Furthermore, control by means of a spring element is always associated with insecurities as temperature fluctuations can also, for example, influence the spring characteristics.

The object of the invention is to provide a mass inertia-based actuation system for a locking system of a motor vehicle, with which a defined control of the coupling behavior can be provided in an actuating train of a locking device of a motor vehicle lock. The object of the invention is to provide an improved locking device for a motor vehicle.

Moreover, it is an object of the invention to provide a structurally simple and cost-effective way to secure a locking device in the event of an accident.

The task is solved according to the invention by the characteristics described herein. Advantageous designs of the invention are further specified herein. It is pointed out that the exemplary embodiments described hereafter are not restrictive; instead, any possible variations are possible of the characteristics described in the description and the drawings.

According to claim 1, the object of the invention is achieved in that a locking device for a motor vehicle with an actuating means, in particular an external actuating lever and/or an internal actuating lever, a lock with a locking mechanism provided, comprising a catch and at least one pawl, wherein the actuating lever and the lock with a Bowden cable are connectable and wherein the Bowden cable has a means for actively locking a force transmitted by means of the Bowden cable. With the inventive design of a Bowden cable with a means for active locking, it is now possible to intervene directly in the transmission path between the lock and the actuating means.

The locking device has an actuating means, at least one Bowden cable and a motor vehicle lock, wherein in the Bowden cable has an inserted functional unit for blocking the transmission of the force by means of the Bowden cable. Here, the functional unit containing the mass inertia element can be installed at any point of the Bowden cable. The Bowden cable, or the Bowden pull cable and the Bowden cable sheath are interrupted in their chain of effects and the functional unit is added.

In one embodiment, an advantage is achieved when the locking device comprises a release lever, an actuating lever and a coupling lever, wherein the release lever is coupled by means of the coupling lever with the actuating lever and the coupling lever by means of a control cam is feasible. Due to the formation of a control curve according to the invention in which the coupling lever can be controlled, the possibility is now created of guiding the coupling lever regardless of the engagement with a spring element and thus obligatorily causing a defined movement of the coupling lever.

Forced guidance of the coupling lever contains a defined location regulation of the coupling lever at all times which includes a high degree of security and functionality in turn. In particular, by means of forced guidance of the coupling lever in a control curve great forces can be transmitted so that malfunction cannot occur, even with slow operation of the actuating lever executed with great force.

In particular, the coupling joint is adjustable at all times at a defined position and by means of formation of the control curve to the different areas of application of the locking device in the motor vehicle.

The locking device for a motor vehicle also includes such locking devices, for example, used in sliding doors, tailgate locks, lateral doors, flaps, or covers such as a hood. The locking device usually comprises a Bowden cable, an actuating means and a lock with a locking mechanism consisting of a catch and at least one pawl. The locking mechanism can be formed with a pre-rest and/or a main catch, with one or two pawls being used.

A release lever is the lever which acts directly on the locking mechanism. The release lever acts on the pawl and disengages the pawl out of engagement with the catch. A coupling lever acts between the actuating lever and the release lever. During operation of the actuating lever and preferably the external actuating lever the coupling lever comes into contact with the release lever and thus enables operation of the release lever, whereby the locking mechanism can be unlocked. The coupling lever is guided in a control curve so that a defined alignment of the coupling lever can be enabled on the release lever. On the one hand, the alignment of the coupling lever can be controlled. Furthermore, the deflection behavior of the coupling lever can also be set by a course of the contour. It is possible to control the deflection angle and also the deflection speed of the coupling lever by the course of the contour. According to the present path during operation of the actuating lever the movement of the coupling lever can thus be set.

In a preferred embodiment of the invention, the coupling lever is pivotally mounted in the actuating lever. The coupling lever is accommodated in the actuating lever and in particular in the external actuating lever offers the advantage that coupling of the actuating lever with the release lever can be enabled with a low number of components. Furthermore, the transmission of the movement from the actuating lever to the release lever is directly possible. The pivoting accommodation of the coupling lever in the actuating lever hereby enables the coupling lever to be accommodated in the actuating lever on the one hand and is simultaneously guided by the control curve.

If the coupling lever can be guided by means of a control lever, a further advantageous embodiment of the invention thus results. The accommodation of the coupling lever or the guidance of the coupling lever in a control lever hereby enables the control curve to follow the movements of the actuating lever. The control curve can thus be moved jointly with the actuating lever and engaged with the coupling lever jointly with the coupling lever. It is apparent from this arrangement that the control lever can function as a control joint if the control lever executes a relative movement to the actuating lever.

During normal operation of the actuating lever, by means of the engagement of a spring between the actuating lever and the control lever the control lever follows the movement of the actuating lever. The coupling lever is accommodated in the actuating lever and follows the movement of the actuating lever. If the actuating lever is moved at a speed assigned to the operation in normal operation, the control lever thus follows the movement of the actuating lever. The spring acting between the control lever and the actuating lever is configured in such a way that a concurrent movement occurs in normal operation between the control lever and the actuating lever.

Only in the case of an excessive speed of the actuating lever, as may occur, for example, in the event of an accident, the actuating lever is accelerated so greatly a relative movement occurs between the control lever and the actuating lever. A relative movement between the control lever and the actuating lever causes the coupling lever to be directed in the control curve of the control lever and can be deflected by the geometry of the control lever contour. Deflection of the coupling lever hereby causes the coupling lever to disengage with the release lever. The Bowden cable is blocked in its operation and thus the locking mechanism remains locked.

In a further embodiment of the invention, there is an advantage if the control lever is mounted at least with the actuating lever in a common axis. Joint accommodation of the control lever and the actuating lever enables a structurally simple configuration which requires little space. Furthermore, the operating paths and lever moments can easily be attuned to one another by means of the joint accommodation. In particular, the forces to be transmitted, which are required on the one hand to trigger the locking mechanism and, on the other hand can make available a control of the movement of the coupling lever, are easily set.

If the control lever interacts with a mass inertia lever, a further advantageous configuration of the invention thus results. A mass inertia lever is a lever which is pivotably accommodated in the motor vehicle lock and counteracts a momentum from an accident. The mass inertia element is preferably formed as a lever and is located centrally. Symmetrical load distribution around the pivot point can be advantageous. The control lever is directly engaged with the mass inertia lever.

As already explained above, during a relative movement between the actuating lever and the control lever a deflection of the coupling lever occurs. Due to the inert mass of the mass inertia lever the control lever is assisted in its inertia behavior so that further security is guaranteed in order to hold the control lever in its position in the case of accident.

If the mass inertia lever counteracts the momentum of the impact, the inertia lever remains in its position and holds the control lever against the deflection of the actuating lever in its starting position. Only the actuating lever is thus deflected, for example by means of a moved door handle and the control lever remains in its starting position. During operation of the actuating lever, the coupling lever follows the movement of the actuating lever by means of its accommodation in the actuating lever, whereby the coupling lever is guided by means of the control curve of the control lever and can be deflected accordingly. The operation of the actuating lever in the event of an accident thus has no effect on the release lever, so that the locking device remains closed even in the event of an accident.

If the control lever is guided in a control contour of the mass inertia lever, a further embodiment of the invention results. By means of direct guidance of the control lever in a contour of the mass inertia lever, an advantageous structural solution results which is equipped with a minimum number of components.

Furthermore, it is advantageous if the control lever engages into the contour of the mass inertia lever such that an attack point of the control lever is arranged in the control contour close to the pivot point of the mass inertia lever. By means of an attack point or a guidance of the control lever in the mass inertia lever close to the pivot point of the mass inertia lever the control lever counteracts great mass inertia in the case of accident. In particular where a symmetrical mass distribution is present around the rotational point of the mass inertia lever, in the case of accident the mass inertia lever can counter a maximum inertia moment for the control lever.

Advantageously, the control contour extends from a pivot point of the mass inertia lever located approximately centrally to a radial end of the mass inertia lever. A further advantageous form of the control contour hereby results as on the one hand the mass inertia lever can counter the control lever with a maximum inertia moment in the case of accident. In contrast, during normal operation of the actuating lever the control lever only needs to apply a smaller moment along the control contour in the mass inertia lever with increasing deflection of the actuating lever in order to deflect the mass inertia lever. As a result, a power transmission is facilitated by means of the Bowden cable for actuating the lock. The advantageous embodiment of the control contour along the extension of the mass inertia lever thus has a positive effect on the behavior during the accident and at the same time in the normal operation of the locking device.

A further advantageous configuration of the invention results if the control lever has an engagement means, in particular an extension, whereby during operation of the engagement means the coupling lever can be disengaged from the release lever. The control lever may have an engagement means, in which, for example, a central locking element of the lock can engage. Advantageously the engagement means can be formed as an extension, for example, which protrudes out of the control lever. However, the engagement means can also be formed from an aperture, a depression or another geometric design into which a central bolting means can engage and fixes the control lever in its position. By means of fixing of the engagement means and thus the control lever, although the actuating lever or the external actuating lever can be operated, by means of holding or fixing of the control lever the coupling lever is moved by means of the control curve in the control lever and disengaged with the release lever. Hereby with the simplest structural means a bolting element can be provided which grips the available elements of the flow system and in particular the control lever. Bolting can thus be enabled by positioning of the control lever.

Advantageously, the engagement means can be molded as a single component to extend the control lever, for example. However, it is naturally also conceivable to fix the control lever in another force-fitting and/or form-fitting form so that movement of the control lever can be prevented.

If the engagement means can be operated electrically, a further advantageous configuration of the invention thus results. Electrical operation offers the advantage of a high level of convenience for the operator so that the control lever can be electrically controlled or positioned or fixed within the scope of central locking of the motor vehicle, for example. Thus, the functional unit of the locking device itself serves as a central locking.

In a further advantageous embodiment, at least one part of the coupling lever protrudes into an opening of the actuating lever and can be guided into the aperture. In normal operation of the actuating lever, i.e. during operation of the actuating lever with normal opening speed for the lock, the coupling lever lies adjacent to an end of the actuating lever in a spring pre-tensioned manner, for example. If the control lever is now fixed, this can occur on the one hand by means of the engagement means and a central locking system or by means of the mass inertia element, the coupling lever thus travels in the control curve of the control lever, whereby the coupling lever is pivoted. In order to enable pivoting of the coupling lever in the actuating lever, the coupling lever can be guided in the aperture of the actuating lever.

Guidance of the coupling lever directly in the actuating lever offers a further option in order to enable a possibility which is as structurally simple as possible and therefore cost-effective to guide the coupling lever with full functionality. The construction of the interlocking guides of the mass inertia lever, control lever, coupling lever and actuating lever offers a variety of advantages for the functionality and at the same time offers the opportunity to use all functional advantages with the lowest possible number of components and structurally favorable structure.

In a further advantageous embodiment of the locking device, the actuating lever, the control lever and the release lever are mounted on a common axis and/or guide. The joint mounting of the levers offers the advantage that the functional unit can be designed as small as possible, so that with minimal space requirements in the motor vehicle, for example, in a lateral door or a sliding door, a high degree of functionality is feasible. The levers can be accommodated coaxially and/or on a joint guide or mounting of the other lever in each instance. In particular the coaxial mounting of the lever offers the advantage that in particular for the interplay, for example, between the control lever and the actuating lever beneficial engagement relationships, for example, for the spring acting between the control lever and the actuating lever are provided.

The invention is described in further detail below with reference to the attached drawings on the basis of a preferred execution example. However, the principle applies that the exemplary embodiments do not restrict the invention, but only constitute advantageous embodiments. The illustrated characteristics can be executed individually or in combination with further characteristics of the description and also the patent claims individually or in combination.

BRIEF DESCRIPTION OF DRAWINGS

The following are shown.

DETAILED DESCRIPTION

Figure 1:
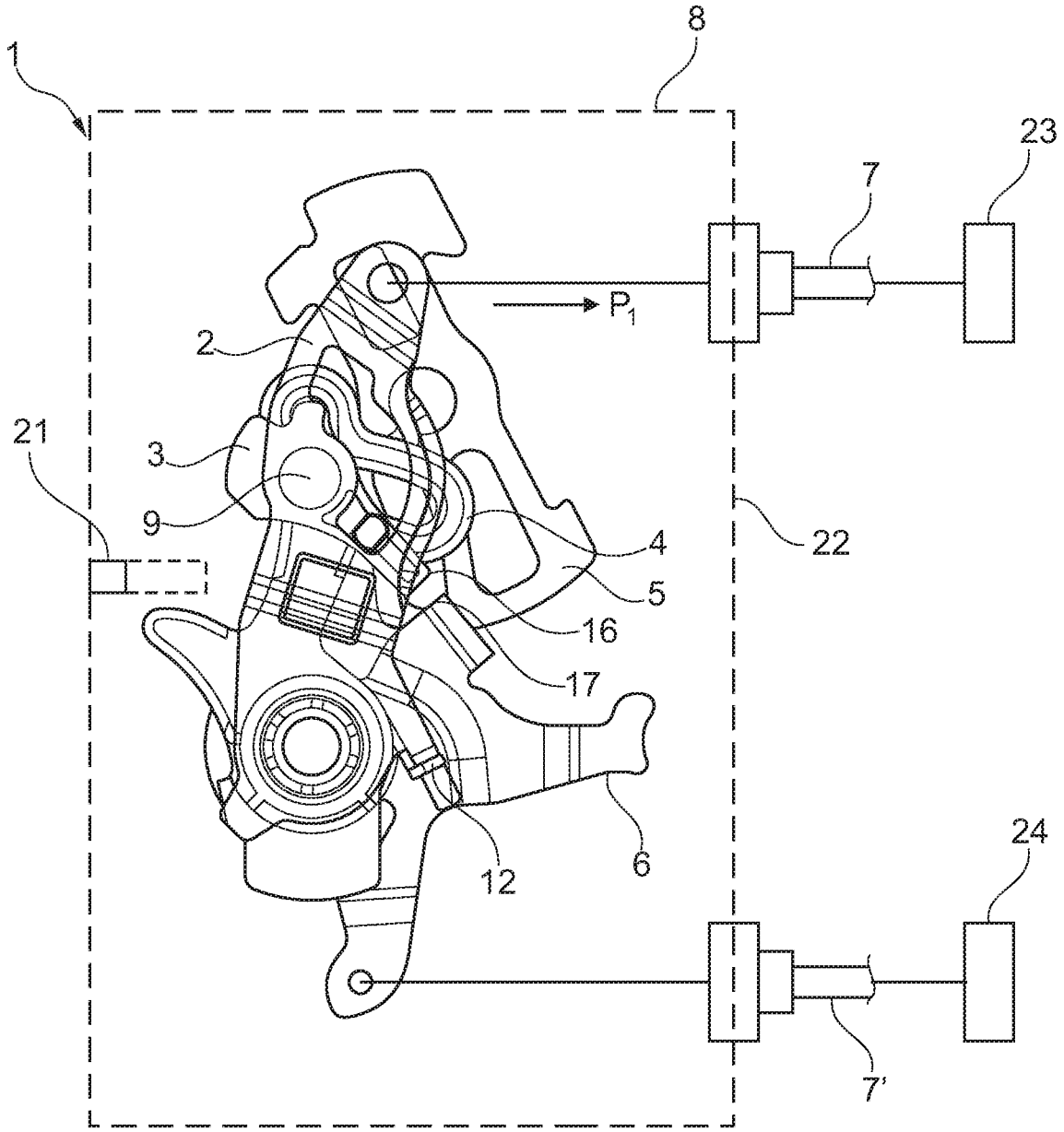
FIG. 1 the principle of a locking device of a motor vehicle with the essential components to explain the invention. The illustration shows the functional unit in a starting position, that is to say in the unactuated state, FIG. 2 the rear view of the functional unit according to FIG. 1 in the nonactuated state, that is to say a starting position, FIG. 3 a front view of the functional unit of the lock in a normal operation of the Bowden cable and FIG. 4 a front view of the functional unit with greatly accelerated movement of the actuating lever, in which the mass inertia element prevents transfer of the force via the Bowden cable.

FIG. 1 shows a basic representation of a locking device 1 of a motor vehicle. The functional unit 8 in the locking device 1 is merely indicated as a dashed line. The functional unit 8 comprises an actuating lever 2, a coupling lever 3, a control lever 4, a mass inertia lever 5, and a release lever 6. The further components of locking device 1 are dispensed with for the sake of clarity, so that only the crucial components of locking devicel are reproduced to explain the function of the invention.

FIG. 1 shows the functional unit 8 in an unactuated state. For operating the actuating lever 2, the actuating lever 2 is operated, for example, by means of a Bowden cable 7 in the direction of arrow P1 in the clockwise direction. During operation of the actuating lever 2, the coupling lever 3 accommodated in the actuating lever 2 is moved via its axis 9 accommodated in the actuating lever 2.

Figure 2:
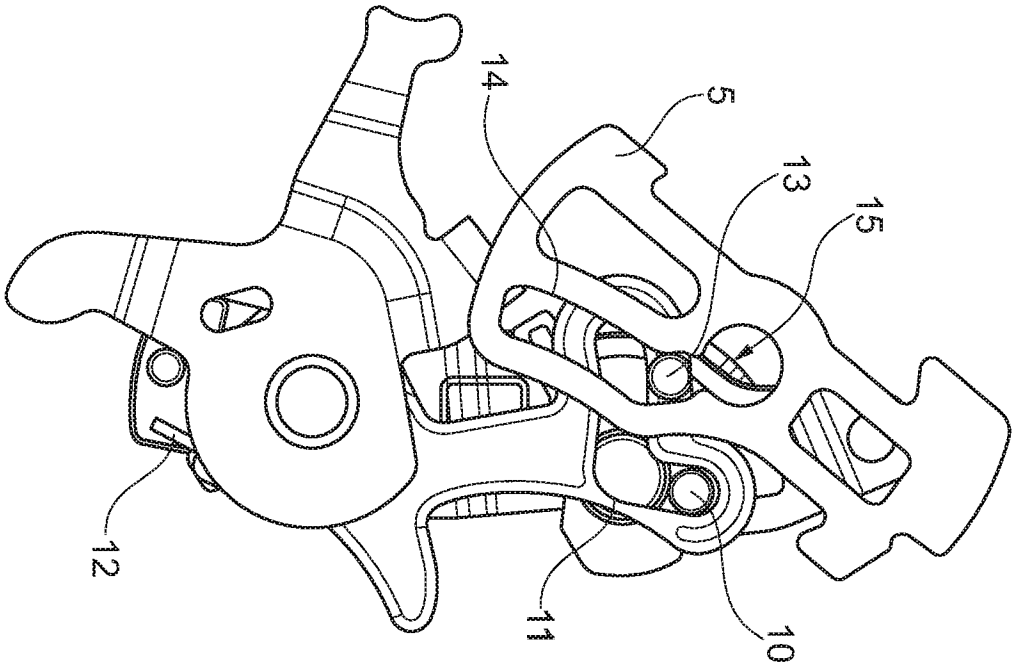

The coupling lever 3 in turn has a tap 10 which is more clearly visible in FIG. 2, with which the coupling lever 3 engages into the control curve 11 of the control lever 4. The actuating lever 2 takes along the control lever 4 in operation of the actuating lever 2 in the direction of the arrow P1. In this case, a spring element 12 acts between the actuating lever 2 and the control lever 4. The spring element 12 holds the control lever 4 in its starting position so that the spring element 12 acts with a relative force between the control lever 4 and the actuating lever 2 to a relative movement between the actuating lever 2 and the control lever 4. The spring force of the spring element, which can be a spiral spring or leg spring in particular, must be overcome in order to create a relative movement between the actuating lever 2 and the control lever 4.

If the pin 10 of the coupling lever 3 interacts with the control lever 4, the control lever 4 in turn thus interacts with the mass inertia lever 5 by means of a guide pin 13. For this purpose, the guide pin 13 engages into a control curve 14 of the mass inertia lever 5. As can be seen clearly in FIG. 2, the guide pin 13 in the control curve 14 is radial, that is to say it can be guided or pivoted outward on a path which can be described as a circular path about the bearing point of the control lever 4. The mass inertia lever 5 is pivotally mounted around its axis 15 in the functional unit 8. The mass inertia lever 5 preferably has a mass distribution which is in equilibrium in relation to the axis 15. In other words, the mass inertia lever 5 is offset in mass around the axis 15. An offset mass balance in relation to the axis 15 offers the advantage that no natural oscillations can arise due to vibrations in the motor vehicle or can be largely prevented.

Upon operation of the actuating lever 2, therefore, the coupling lever 3 is operated, and in the case where the actuating lever is operated at a normal speed, the control lever 4 follows the movement of the actuating lever 2. This has the consequence that the coupling lever 3 maintains its orientation in the functional unit 8. A radial end 16 of the coupling lever 3 then engages with a stop edge 17 of the release lever 6. Such an engagement between the radial end 16 of the coupling lever 3 and the stop edge 17 is reproduced as a normal operation of the lock in FIG. 3. In other words, a movement can be transmitted to the release lever 6.

Figure 3:
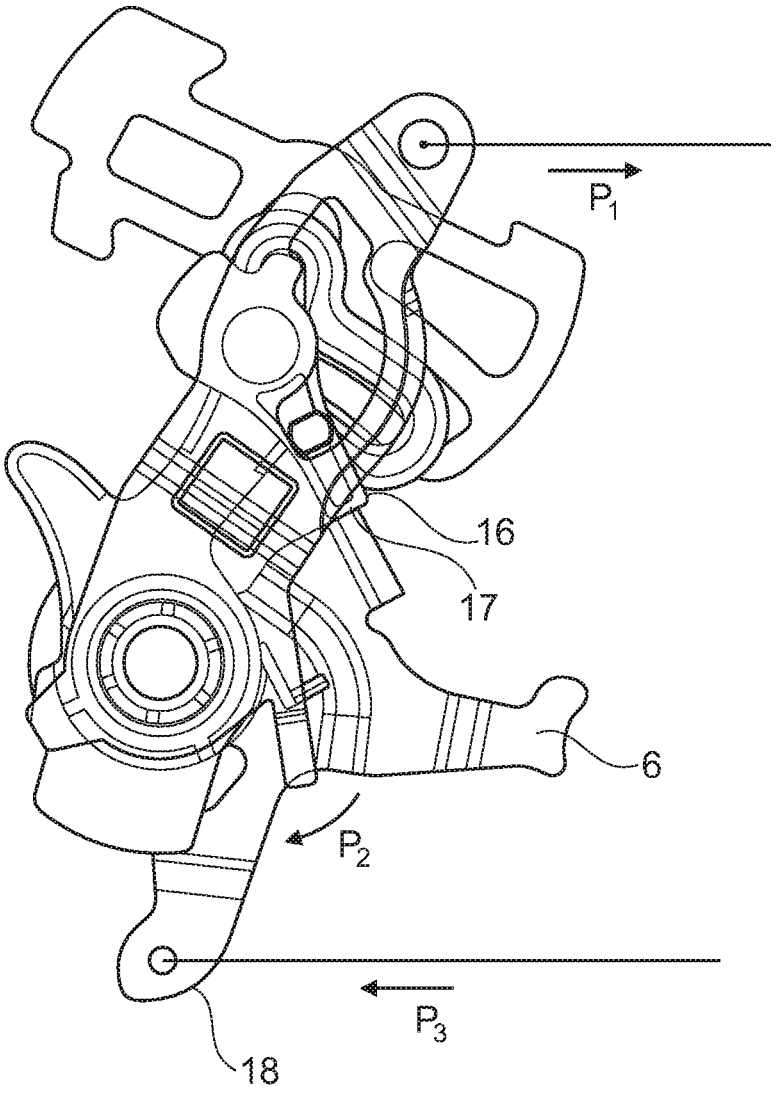

Upon actuation of the release lever 6, as shown in FIG. 3, the release lever 6 performs a movement in the direction of the arrow P2, whereby a release arm 18 is pivoted in the direction of the arrow 3.

Figure 4:
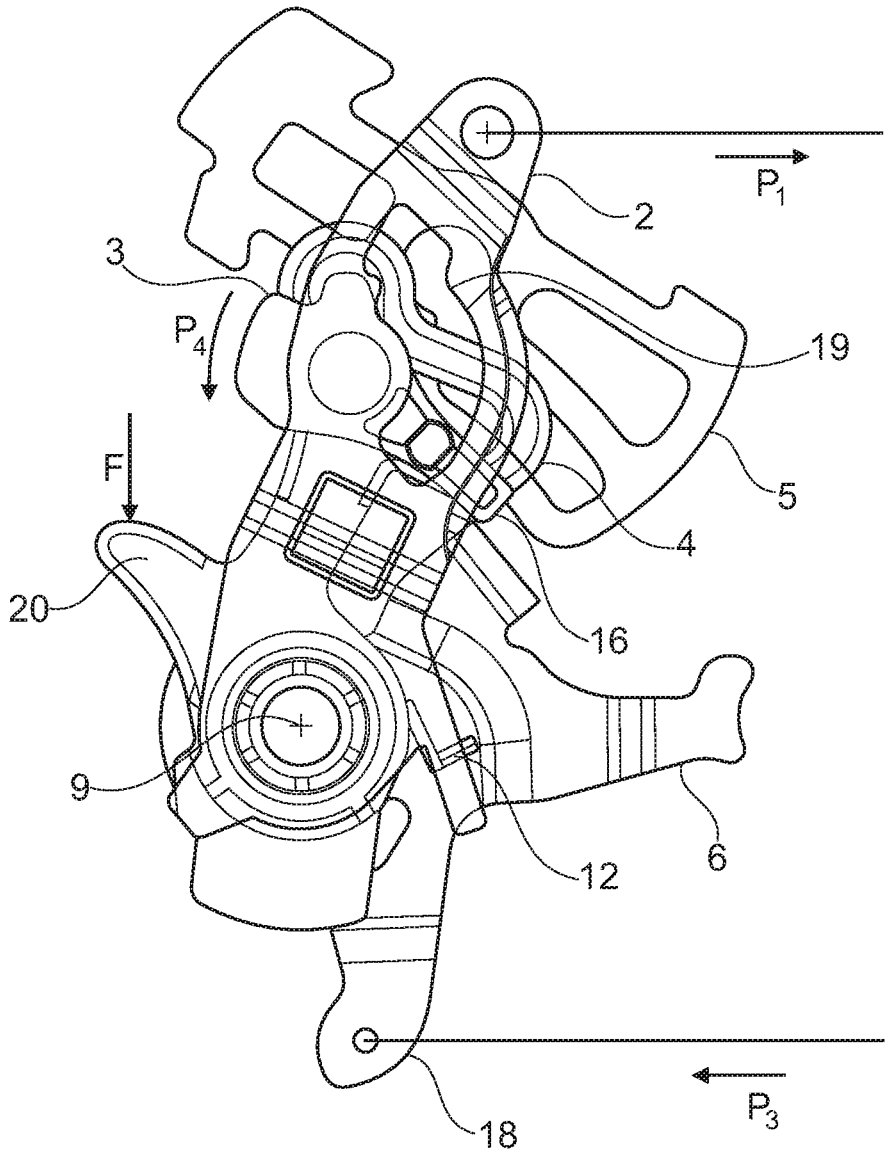

The case is now illustrated in FIG. 4 in which the actuating lever 2 is rotated with excess speed in the direction of the arrow P1 around the axis 9 in a clockwise direction. Excessive speed leading to excessively quick movement of the actuating lever 2 above a limit speed results on the one hand to the spring element 12 being deflectable and simultaneously to that the mass inertia element cannot follow the accelerated movement of the actuating lever 2.

The coupling lever 3 is accommodated in the actuating lever 2 and must follow the movement of the actuating lever 2. However, as the control lever 4 remains in its starting position, the pin 10 of the coupling lever 3 is guided in the control curve 11 of the control lever 4. As a result, the coupling lever 3 pivots in the counterclockwise direction in FIG. 4 and disengages from the release lever 6. As can be clearly seen in FIG. 4, the radial end 16 of the coupling lever 3 is disengaged from the stop edge 17 of the release lever 6. The release lever 6 remains in its initial position, so that the release arm 18 is not brought into contact with the locking mechanism 7. In this movement, the coupling lever 3 also moves in the aperture 19 of the actuating lever 2.

In order to disengage the coupling lever 3 with the release lever 6, the control lever 4 furthermore has an engagement means 20 which is formed as an extension 20 in this embodiment. If, for example, a lever 21, which can also be designated as a locking lever 21, engages the extension 20 in the lock 1, the lever 21 exerting a force F on the extension 20, then the control lever 4 also remains in its starting position. The remaining of the control lever 4 in its starting position causes the coupling lever 3 to be guided in the control curve 11 of the control lever 4 during operation of the actuating lever 2 and thus the coupling lever 3 disengages with the release lever 6. Thus, the lock 1 can be locked by means of the lever 21, as shown by way of example in FIG. 1.

As is clearly apparent in the exemplary embodiment, a multitude of advantages are attained by the exemplary embodiment, whereby only the least possible spatial requirements are necessary, whereby the highest level of security can be attained by the construction, in particular the insertion of a control curve 11 into the control lever 4.

As explained above, by means of operating the Bowden cable 7, a force is introduced into the actuating lever 2, whereby the actuating lever 2 is pivotable. The Bowden cable 7 may be accommodated in a housing 22 of the functional unit 8 and is connected to an actuating means 23, for example to a door inside or outside handle. By operating the actuating means 23, a force can then be transmitted to the functional unit 8.

In a conventional operation, that is, without acting of the mass inertia element 5, a force is transmitted to the release lever 6 by operating the Bowden cable 7 and the release lever 6 is pivoted in the direction of the arrow P3. The force can be transmitted to the other part of the Bowden cable 7'. The other part of the Bowden cable 7' is in turn connected to a lock 24, so that operating the Bowden cable and the functional unit 8 the lock 24 can be unlocked.

The actuating chain of the locking device 1 thus comprises the actuating means 5, the functional unit 8, the Bowden cable 7, 7' and the lock 24. In case of excessive acceleration of the Bowden cable 7, 7', the functional unit 8 blocks the transmission of force and thus prevents unintentional opening of the lock 24 or the locking mechanism in the lock 24.

LIST OF REFERENCE SYMBOLS

| | |
|---|---|
| 1 | Lock |
| 2 | Actuating lever |
| 3 | Coupling lever |
| 4 | Control lever |
| 5 | Mass inertia lever |
| 6 | Release lever |
| 7, 7' | Bowden cable |
| 8 | Functional unit |
| 9 | Axis |
| 10 | Pin |
| 11 | Control curve |
| 12 | Spring element |
| 13 | Guide pin |
| 14 | Control curve |
| 15 | Axis |
| 16 | Radial end |
| 17 | Stop edge |
| 18 | Release arm |
| 19 | Opening |
| 20 | Engagement means, extension |
| 21 | Lever |
| 22 | Housing |
| 23 | Actuating lever |
| 24 | Lock |
| P1, P2, P3, P4 | Arrow |
| F | Force |

The invention claimed is:

1. A locking device for a motor vehicle, the locking device comprising:

an actuator;

a lock with a locking mechanism;

a Bowden cable, wherein the actuator and the lock are connectable to the Bowden cable; and a locking unit that is configured for active locking of a force transmitted by the Bowden cable, wherein the locking unit includes:

an actuating lever that is connected to the Bowden cable and pivotably movable by operation of the Bowden cable;

a coupling lever pivotally mounted on the actuating lever;

a release lever that is engageable with the actuating lever via the coupling lever; and a control lever, wherein when the actuator lever is pivotally moved above a limit speed by the operation of the Bowden cable, the control lever is held in a starting position and the coupling lever disengages from the release lever.

2. The locking device according to claim 1, wherein at least a portion of the coupling lever is guided by the control lever.

3. The locking device according claim 2, wherein the control lever is pivotally mounted at least with the actuating lever along a joint axis.

4. The locking device according to claim 2, wherein the locking unit includes a mass inertia lever, wherein the control lever is engageable with the mass inertia lever.

5. The locking device according to claim 4, wherein the control lever is guided in a control contour of the mass inertia lever.

6. The locking device according to claim 2, wherein the control lever includes an extension, wherein upon actuation of the extension, the coupling lever is disengaged from the release lever.

7. The locking device according to claim 6, wherein the extension is electrically actuated.

8. The locking device according to claim 1, wherein at least part of the coupling lever projects into an opening of the actuating lever and is guided in the opening.

9. The locking device according to claim 2, wherein the actuating lever, the control lever, and the release lever are respectively pivotally and movably mounted on a joint axis.

10. The locking device according to claim 1 further comprising a control curve configured to guide the coupling lever.

11. The locking device according to claim 2, wherein the coupling lever has a pin that engages into a control curve of the control lever.

12. The locking device according to claim 11, wherein the control lever has a guide pin that engages into a second control curve defined by a mass inertia lever.

13. The locking device according to claim 12, wherein the guide pin has a circular path about a bearing point of the control lever.

14. The locking device according to claim 2, wherein the locking unit is movable between an unactuated state and an actuated state, wherein the control lever is in the starting position when the locking unit is in the unactuated state, and wherein the locking unit is moved toward the actuated state by pivotal movement of the actuating lever in a first rotational direction, whereby the pivotal movement of the actuating lever causes movement of the coupling lever and the control lever in the first rotational direction.

15. The locking device according to claim 14 further comprising a spring element arranged between the actuating lever and the control lever, wherein the spring element biases the control lever to the starting position.

16. The locking device according to claim 2 further comprising a locking lever, wherein the control lever has an extension that is engageable by the locking lever for locking the lock.

17. The locking device according to claim 4, wherein the mass inertia lever is offset in mass around an axis of rotation of the mass inertia lever.

18. A locking device for a locking mechanism in a motor vehicle, the locking device comprising:

a Bowden cable for locking and unlocking the locking mechanism;

an actuator lever that is connected to the Bowden cable and pivotably movable by operation of the Bowden cable;

a coupling lever pivotably mounted in the actuating lever, wherein the coupling lever is pivotally moved by pivoting movement of the actuator lever during the operation of the Bowden cable;

a control lever having a control curve into which at least a portion of the coupling lever engages during the pivoting movement of the coupling lever, a mass inertia lever that is engageable with the control lever; and a release lever that is engageable by the coupling lever, wherein during normal operation of the locking device in which the actuator lever is pivotally moved by the operation of the Bowden cable at a first speed, the control lever moves from a starting position and follows the pivoting movement of the actuator lever, such that the coupling lever engages the release lever, and wherein during a secondary operation of the locking device in which the actuator lever is pivotally moved by the operation of the Bowden cable at a second speed that is excessive relative to the first speed, the mass inertia lever holds the control lever in the starting position and the coupling lever disengages from the release lever.

19. A locking device for a motor vehicle, the locking device comprising:

an actuator;

a lock with a locking mechanism;

a Bowden cable, wherein the actuator and the lock are connectable to the Bowden cable; and a locking unit that is configured for active locking of a force transmitted by the Bowden cable, the locking unit including:

an actuating lever;

a release lever;

a coupling lever, wherein the release lever is coupled by the coupling lever with the actuating lever; and a control lever, wherein the coupling lever is guided by the control lever, wherein the locking unit is movable between an unactuated state and an actuated state, wherein the control lever is in a starting position when the locking unit is in the unactuated state, and wherein the locking unit is moved toward the actuated state by movement of the actuating lever in a first rotational direction, whereby the movement of the actuating lever causes movement of the coupling lever and the control lever in the first rotational direction.

* * * * *